US008951406B2

(12) United States Patent
Koseoglu

(10) Patent No.: US 8,951,406 B2
(45) Date of Patent: Feb. 10, 2015

(54) HYDROGEN-ENRICHED FEEDSTOCK FOR FLUIDIZED CATALYTIC CRACKING PROCESS

(75) Inventor: Omer Refa Koseoglu, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 94 days.

(21) Appl. No.: 13/493,270

(22) Filed: Jun. 11, 2012

(65) Prior Publication Data

US 2013/0026067 A1 Jan. 31, 2013

Related U.S. Application Data

(60) Provisional application No. 61/513,303, filed on Jul. 29, 2011.

(51) Int. Cl.
*C10G 47/00* (2006.01)
*C10G 11/18* (2006.01)
(Continued)

(52) U.S. Cl.
CPC ..... *C10G 11/18* (2013.01); *C10G 45/20* (2013.01); *C10G 45/22* (2013.01); *C10G 47/30* (2013.01); *C10G 49/007* (2013.01);
(Continued)

(58) Field of Classification Search
USPC ..... 208/85, 108, 113, 121; 261/19, 23.1, 261/38, 40, 42, 76, 78.1
See application file for complete search history.

(56) References Cited

U.S. PATENT DOCUMENTS 3,770,615 A 11/1973 Blazek
3,884,795 A 5/1975 Wright et al.
(Continued)

FOREIGN PATENT DOCUMENTS

EP 0171460 A1 2/1986
EP 0309219 A1 3/1989
(Continued)

OTHER PUBLICATIONS

Speight, J.G. (1999), The Chemistry and Technology of Petroleum, 3rd ed, Marcel-Dekker, 918 pgs (Office action cites Table 1-3).*
(Continued)

*Primary Examiner* — Brian McCaig
(74) *Attorney, Agent, or Firm* — Abelman, Frayne & Schwab

(57) ABSTRACT

A process for catalytically cracking a hydrocarbon oil containing sulfur and/or nitrogen hydrocarbon constituents by dissolving excess hydrogen in the liquid hydrocarbon feedstock in a mixing zone at a temperature of 420° C. to 500° C. and a hydrogen-to-feedstock oil volumetric ratio of 300:1 to 3000:1, flashing the mixture to remove remaining hydrogen and any light components in the feed, introducing the hydrogen saturated hydrocarbon feed into an FCC reactor for contact with a catalyst suspension in a riser or downflow reactor to produce lower boiling hydrocarbon components which can be more efficiently and economically separated into lower molecular weight hydrocarbon products, hydrogen sulfide and ammonia gas and unreacted hydrogen in a separation zone. Hydrogen present in the liquid phase enhances the desulfurization and denitrification reactions which occur during the conversion process and allows for the removal of significantly more sulfur- and/or nitrogen-containing contaminants from the feedstock in an economical fashion.

13 Claims, 5 Drawing Sheets

(51) Int. Cl.

| | |
|---|---|
| ***C10G 45/20*** | (2006.01) |
| ***C10G 45/22*** | (2006.01) |
| ***C10G 47/30*** | (2006.01) |
| ***C10G 49/00*** | (2006.01) |

(52) U.S. Cl.

CPC ... *C10G 2300/202* (2013.01); *C10G 2300/207* (2013.01); *C10G 2400/02* (2013.01)

USPC ..... 208/85; 208/108; 208/113; 208/121

(56) References Cited

U.S. PATENT DOCUMENTS

| | | | | |
|---|---|---|---|---|
| 4,048,057 | A | 9/1977 | Murphy | |
| 4,115,250 | A | 9/1978 | Flanders et al. | |
| 4,179,354 | A | 12/1979 | Frayer et al. | |
| 4,316,794 | A | 2/1982 | Schoennagel | |
| 4,325,811 | A | 4/1982 | Sorrentino | |
| 4,345,992 | A | 8/1982 | Washer et al. | |
| 4,639,308 | A | 1/1987 | Lee | |
| 4,666,586 | A | 5/1987 | Farnsworth | |
| 4,666,588 | A | 5/1987 | Murphy | |
| 4,717,466 | A | 1/1988 | Herbst et al. | |
| 4,802,971 | A | 2/1989 | Herbst et al. | |
| 4,853,105 | A | 8/1989 | Herbst et al. | |
| 4,883,583 | A | 11/1989 | Mauleon et al. | |
| 4,927,522 | A | 5/1990 | Herbst et al. | |
| 4,988,430 | A | 1/1991 | Sechrist et al. | |
| 5,328,591 | A | 7/1994 | Raterman | |
| 5,338,438 | A | 8/1994 | Demoulin et al. | |
| 5,538,623 | A | 7/1996 | Johnson et al. | |
| 6,123,830 | A | 9/2000 | Gupta et al. | |
| 7,001,502 | B1 | 2/2006 | Satchwell et al. | |
| 7,029,571 | B1 * | 4/2006 | Bhattacharyya et al. | 208/76 |
| 7,449,104 | B2 | 11/2008 | Sughrue et al. | |
| 2002/0148755 | A1 | 10/2002 | Ackerson et al. | |
| 2008/0314799 | A1 | 12/2008 | Li et al. | |
| 2009/0000986 | A1 * | 1/2009 | Hassan et al. | 208/108 |
| 2010/0270205 | A1 * | 10/2010 | Lopez et al. | 208/17 |

FOREIGN PATENT DOCUMENTS

| | | | |
|---|---|---|---|
| EP | 0489723 | A2 | 6/1992 |
| EP | 2169031 | A1 | 3/2010 |

OTHER PUBLICATIONS

International Search Report and Written Opinion mailed Sep. 19, 2012 by the European Patent Office in International Application No. PCT/US2012/041857.

* cited by examiner

HYDROGEN-ENRICHED FEEDSTOCK FOR FLUIDIZED CATALYTIC CRACKING PROCESS

RELATED APPLICATIONS

This application claims the benefit of U.S. Provisional Patent Application No. 61/513,303 filed Jul. 29, 2011, the disclosure of which is hereby incorporated by reference.

BACKGROUND OF THE INVENTION

1. Field of the Invention

This invention relates to a process and system for fluidized catalytic cracking of hydrocarbon feedstocks.

2. Description of Related Art

Crude oils are used as feedstocks for producing transportation fuels and petrochemicals. Typically fuels for transportation are produced by processing and blending of distilled fractions from the crude to meet particular end use specifications. While compositions of natural petroleum or crude oils are significantly varied, all crude oils contain organosulfur and other sulfur-containing compounds. Generally, the concentration of sulfur-containing hydrocarbon compounds in whole crude oil is less than about 5 weight percent, with most crude having sulfur concentrations in the range from about 0.5 to about 1.5 weight percent. Because many crude oil sources available today are high in sulfur, the distilled fractions must be desulfurized to yield products which meet performance specifications and/or environmental standards. Even after desulfurization, hydrocarbon fuels can still contain undesirable amounts of sulfur.

There are two basic modes for catalytic conversion of hydrocarbon feedstocks into lower boiling point hydrocarbons. The first mode is the catalytic conversion of hydrocarbon feedstock with added hydrogen at reaction conversion temperatures less than about 540° C. and the reaction zone comprising a fixed bed of catalyst. The second mode is catalytic conversion of hydrocarbons without the addition of hydrogen to the conversion zone, which is typically conducted at temperatures of about 480° C. to about 550° C. using a circulating stream of catalyst.

The first mode, commonly known as a fixed bed hydrocracking processes, has achieved commercial acceptance by petroleum refiners, but this process has several disadvantages. In order to attempt to achieve long runs and high on-stream reliability, fixed bed hydrocrackers require a high inventory of catalyst and a relatively high pressure reaction zone which is generally operated at 150 kg/cm$^2$ or greater to achieve catalyst stability. In addition, two-phase flow of reactants (liquid hydrocarbon feedstock and gaseous hydrogen) over a fixed bed of catalyst often creates uneven distribution within the reaction zone, resulting in inefficient utilization of catalyst and incomplete conversion of the reactants. Further, momentary mis-operation or electrical power failure can cause severe catalyst coking which may require the process to be shut down for offline catalyst regeneration or replacement.

The second mode, commonly referred to as fluidized catalytic cracking (FCC), is well established for conversion of relatively high molecular weight hydrocarbon fractions such as vacuum gas oil and residues into gasoline and other products. FCC is considered to be one of the most important conversion processes used in petroleum refineries, and has certain advantages, including the ability to operate in the absence of an influent hydrogen stream and at relatively low pressure, i.e., about 3 kg/cm$^2$ to about 4 kg/cm$^2$ or less. However, this mode is incapable of upgrading the hydrocarbon product by hydrogenation, and requires relatively high reaction temperatures which accelerate conversion of hydrocarbons into coke thereby decreasing the potentially greater volumetric yield of the normally liquid hydrocarbon product. This coke forms on the catalyst and the FCC processes therefore require catalyst regeneration to burn off the coke and after which the catalyst is recycled.

In typical FCC processes, hydrocarbon feedstock is preheated to 250-420° C. and contacted with hot catalyst at about 650-700° C. either in the reactor or in a catalyst riser associated with the reactor. Catalysts include, for instance, crystalline synthetic silica-alumina, known as zeolites, and amorphous synthetic silica-alumina. The catalyst and the reaction products are separated mechanically in a section of the reactor. The cracked oil vapors are conveyed to a fractionation tower for separation into various products. Catalyst is sent for removal of any oil remaining on the catalyst by steam stripping and regeneration by burning off the coke deposits with air in the regeneration vessel.

In the operation of a conventional oil refinery, various processes occur in discrete units and/or steps. This is generally due to the complexity of naturally occurring crude oil mixtures, and the fact that crude oil feedstocks processed at refineries often differ in quality based on the location and age of the production well, pre-processing activities at the production well, and the means used to transport the crude oil from the well to the refinery plant.

Sulfur-containing hydrocarbon compounds that are typically present in hydrocarbon fuels include aliphatic molecules such as sulfides, disulfides and mercaptans, as well as aromatic molecules such as thiophene, benzothiophene, dibenzothiophene and alkyl derivatives such as 4,6-dimethyldibenzothiophene, and aromatic derivatives such as napthenodibenzothiophenes. Those later molecules have a higher boiling point than the aliphatic ones and are consequently more abundant in higher boiling fractions.

The process of these sulfur-containing organic compounds in fuels constitutes a major source of environmental pollution. The sulfur compounds are converted to sulfur oxides during the combustion process and produce sulfur oxyacids and contribute to particulate emissions. Oxygenated fuel blending compounds and compounds containing few or no carbon-to-carbon chemical bonds, such as methanol and dimethyl ether, are known to reduce smoke and engine exhaust emissions. However, most such compounds have high vapor pressures and/or are nearly insoluble in diesel fuel, and also have poor ignition quality. Purified diesel fuels produced by chemical hydrotreating and hydrogenation to reduce their sulfur and aromatics contents also suffer a reduction in fuel lubricity. Diesel fuels of low lubricity may cause excessive wear of fuel pumps, injectors and other moving parts which come in contact with the fuel under high pressure.

In the face of ever-lower government sulfur specifications for transportation fuels, sulfur removal from petroleum feedstocks and products is becoming increasingly important and will be more so in years to come. In order to comply with performance and environmental regulations for ultra-low sulfur content fuels, refiners will have to make fuels having even lower sulfur levels at the refinery.

The aliphatic sulfur compounds are easily desulfurized using conventional HDS methods, but some of the highly branched aliphatic molecules can hinder the sulfur atom removal and are moderately harder to desulfurize. Likewise, the aromatic derivatives are also difficult to remove.

For example, among the sulfur-containing aromatic compounds, thiophenes and benzothiophenes are relatively easy to hydrodesulfurize while the addition of alkyl groups to the ring compounds slightly increases hydrodesulphurization difficulty. Dibenzothiophenes resulting from adding another ring to the benzothiophene family are significantly more difficult to desulfurize and the difficulty varies greatly according to their alkyl substitution with di-beta substitution being the most difficult to desulfurize justifying their "refractory" appellation. These so-called beta substituents hinder the sulfur heteroatom from seeing the active site on the catalyst. HDS units are not efficient to remove sulfur from compounds where the sulfur atom is sterically hindered as in multi-ring aromatic sulfur compounds. This is especially true where the sulfur heteroatom is hindered by two alkyl groups, e.g., 4,6-dimethyldibenzothiophene. However, these hindered dibenzothiophenes predominate at low sulfur levels such as 50 to 100 ppm.

In order to meet stricter sulfur specifications in the future, such hindered sulfur compounds will also have to be removed from distillate feedstocks and products. Hydroprocessing including the conventional hydrodesulfurization and hydrocracking technologies is currently the most accepted route to desulfurize the sulfur-containing hydrocarbon fractions to produce clean fuels.

However, severe operating conditions (i.e., increased hydrogen partial pressure, higher temperature, and catalyst volume) must be applied to remove the sulfur from these refractory sulfur compounds. The increase of hydrogen partial pressure can only be done by increasing the recycle gas purity in existing units. Alternatively, new grassroots units will have to be designed, which is a costly option. The use of severe operating conditions results in yield loss, less catalyst cycle and product quality deterioration (e.g., color).

The economical removal of the so called refractory sulfur is then exceedingly difficult to achieve and therefore the removal of sulfur compounds in hydrocarbon fuels boiling in diesel range to a sulfur level below about 10 ppm is very costly by known current hydrotreating techniques. In order to meet the more stringent sulfur specifications, these refractory sulfur compounds have to be removed from hydrocarbon fuel.

It would be desirable to provide processes and systems that efficiently and economically results in improved hydrocarbon product quality and yield without substantial addition of costly equipment, hardware and control systems to existing facilities.

SUMMARY OF THE INVENTION

The present invention broadly comprehends a process and system for the conversion of a liquid hydrocarbon feedstock into lower molecular weight hydrocarbon compounds in a fluidized catalytic cracking reaction and separation zone that includes the steps of:

a. mixing the liquid hydrocarbon feedstock and an excess of hydrogen gas in a mixing zone to dissolve a portion of the hydrogen gas in the liquid hydrocarbon feedstock to produce a hydrogen-enriched liquid hydrocarbon feedstock;

b. introducing the hydrogen-enriched liquid hydrocarbon feedstock and remaining hydrogen into to a flashing zone in which at least a portion of undissolved hydrogen gas is flashed;

c. introducing the hydrogen-enriched liquid hydrocarbon feedstock from the flashing zone to the fluidized catalytic cracking reaction and separation zone and contacting it with a fluidized catalytic cracking catalyst for reaction, including conversion of the feedstock into lower boiling point hydrocarbons; and d. recovering converted hydrocarbon products from the fluidized catalytic cracking reaction and separation zone.

The process also contemplates upgrading a liquid hydrocarbon feedstock that includes sulfur-containing hydrocarbon compounds by reacting them with hydrogen to produce desulfurized hydrocarbon compounds and hydrogen sulfide, and recovering hydrogen sulfide along with converted hydrocarbon products from the fluidized catalytic cracking reaction and separation zone.

As will be further explained in accordance with other embodiments described below, the invention relates to a system and method of converting hydrocarbon feedstocks into lower boiling point hydrocarbons while also promoting desulfurization and/or denitrification reactions.

The process can also reduce the amount of any nitrogen-containing hydrocarbon compounds present in the feedstock by reacting them with hydrogen to produce denitrified hydrocarbon compounds and ammonia, and recovering the ammonia with converted hydrocarbon products from the fluidized catalytic cracking reaction and separation zone.

This process desirably increases the efficacy of the conventional FCC process by utilizing a refinery's existing FCC unit with relatively minimal apparatus modifications or upgrades to both crack a high boiling point hydrocarbon feedstock and carry out desulfurization and/or denitrification reactions.

BRIEF DESCRIPTION OF THE DRAWINGS

The foregoing summary as well as the following detailed description will be best understood when read in conjunction with the attached drawings. For the purpose of illustrating the invention, there are shown in the drawings embodiments which are presently preferred. It should be understood, however, that the invention is not limited to the precise arrangements and apparatus shown. In the drawings the same numeral is used to refer to the same or similar elements, in which.

DETAILED DESCRIPTION OF THE INVENTION

An improved FCC process is disclosed that includes mixing an excess of gaseous hydrogen with the feedstock prior to introducing it into the FCC reactor. In particular, a mixing zone is integrated so that hydrogen is dissolved in the feedstock, and the liquid and the remaining hydrogen gas mixture is passed to a flashing zone to separate gases from the feedstock containing dissolved hydrogen. The recovered hydrogen is recycled to the mixing zone. The liquid containing dissolved hydrogen is mixed with the cracking catalyst and introduced into the FCC reactor. Thus, a substantially single-phase (i.e., liquid) reaction occurs, in contrast to conventional hydrogen enrichment approaches that include a significant gaseous hydrogen phase and results in stripping of light reaction products.

For the purpose of this simplified schematic illustrations and description, the numerous valves, pumps, temperature sensors, electronic controllers and the like that are customarily employed in refinery operations and that are well known to those of ordinary skill in the art are not shown. Further, accompanying components of conventional FCC processes such as, for example, air supplies, catalyst hoppers, fuel gas handling and FCC distillation apparatus are not shown.

Figure 1:
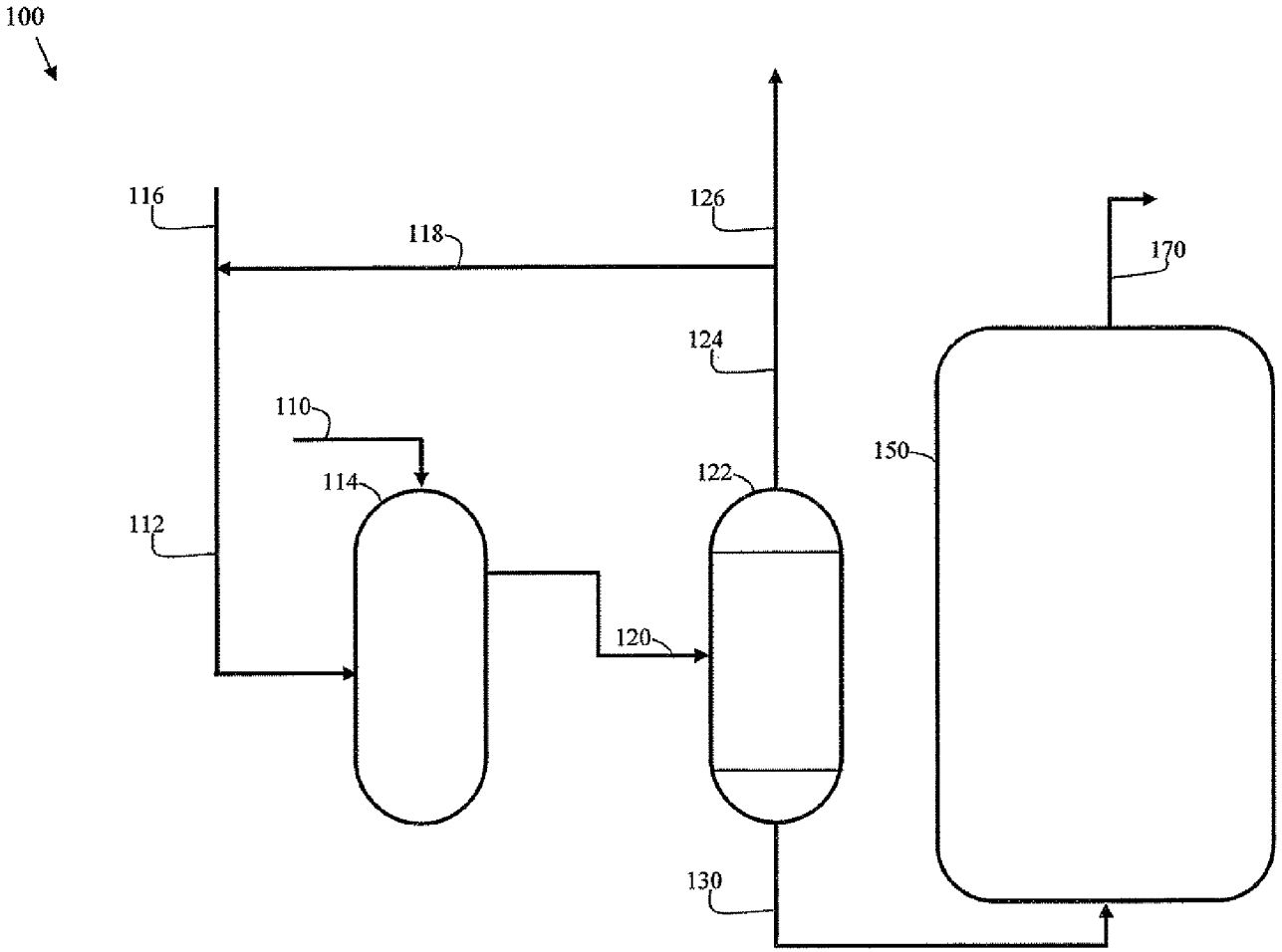
FIG. 1 is a process flow diagram of a hydrogen-enriched fluidized catalytic cracking process in accordance with the present invention.

FIG. 1 is a process flow diagram of a fluidized catalytic cracking process of the invention that includes a hydrogen-enriched feedstock. In general, system 100 includes:

a mixing zone 114 having at least one inlet for receiving a liquid hydrocarbon feedstock stream 110 and at least one inlet for receiving a hydrogen gas stream 112 and an outlet for discharging a combined stream 120;

a flashing zone 122 having an inlet in fluid communication with the outlet discharging combined stream 120, a gas outlet in fluid communication with one or more hydrogen gas inlets of the mixing zone 114, and an outlet for discharging hydrogen-enriched feedstock 130; and an FCC unit 150 having an inlet in fluid communication with the hydrogen-enriched feedstock outlet of the flashing zone 122 and product outlets.

During operation of system 100, liquid hydrocarbon feedstock stream 110 is mixed with hydrogen gas stream 112 in mixing zone 114 to dissolve a predetermined quantity of hydrogen gas in the liquid mixture and produce a hydrogen-enriched liquid hydrocarbon feedstock. The hydrogen gas stream 112 includes fresh hydrogen introduced via stream 116 and recycled hydrogen introduced via stream 118 from the flashing zone 122. Combined stream 120, which includes hydrogen-enriched feedstock and the remaining excess hydrogen gas, is conveyed to the flashing zone 122 in which the hydrogen and other gases (e.g., light feedstock fractions) are flashed off and removed as stream 124. A portion 118 of stream 124 is recycled and mixed with the fresh hydrogen feed 116. The percentage of recycled hydrogen in the hydrogen gas stream 112 will depend upon a variety of factors relating to the excess undissolved hydrogen recovered from the flashing zone 122. The remaining portion of the flashed gases are discharged from the system as a bleed stream 126, which can be distributed or collected for other refinery and/or petrochemical applications (not shown).

The hydrogen-enriched hydrocarbon feedstock, stream 130 which contains a predetermined quantity of dissolved hydrogen, is fed to the FCC unit 150 to undergo cracking reactions. In addition, in embodiments in which the feedstock includes heteroatom-containing hydrocarbons, heteroatom-removal reactions also occur, e.g., desulfurization and denitrification. The cracked oil vapor effluent stream 170 from the reactor portion of the FCC reaction and separation zone 150 is discharged and conveyed into one or more separation vessels, such as fractionation towers (not shown), for product recovery and fractionation into various products.

The initial feedstock for use in above-described apparatus and process can be a crude or partially refined oil product obtained from various sources. The source of feedstock can be crude oil, synthetic crude oil, cracked bitumen, oil sand, cracked shale oil, coal liquids, or a combination including one of the foregoing sources. The feedstock can also be a refinery intermediate stream such as vacuum gas oil; deasphalted oil and/or demetallized oil obtained from a solvent deasphalting process; unconverted hydrocracker bottoms and/or hydrocracker recycle streams, hydrotreated vacuum gas oil, light coker or heavy coker gas oil obtained from a coking process; FCC heavy products such as light cycle oil, heavy cycle oil and clarified slurry oil obtained from a separate FCC process, or recycle stream(s) from the hydrogen-enriched feedstock FCC process described herein; gas oil obtained from a visbreaking process; or other residues from hydroprocessing units; or any combination of the foregoing feedstocks. In certain embodiments, vacuum gas oil is a suitable feedstock for the integrated process.

The hydrogen gas introduced to the mixing zone 114 need not be of high purity. It can contain other hydrocarbons having low boiling points that can either be flashed out or added to the feed.

The mixing zone 114 described in FIG. 1 can be any apparatus that achieves the necessary intimate mixing of the liquid and gas so that sufficient hydrogen is dissolved in the liquid hydrocarbon feedstock. In other embodiments, the mixing zone can include a combined inlet for the hydrogen and the feedstock. Effective unit operations include one or more gas-liquid distributor vessels, which apparatus can include spargers, injection nozzles, or other devices that impart sufficient velocity to inject the hydrogen gas into the liquid hydrocarbon with turbulent mixing and thereby promote hydrogen saturation. Suitable apparatus are described, for instance, in U.S. Pat. Nos. 3,378,349, 3,598,541, 3,880,961, 4,960,571, 5,158,714, 5,484,578, 5,837,208, and 5,942,197, the relevant portions of which are incorporated herein by reference.

Figure 2B:
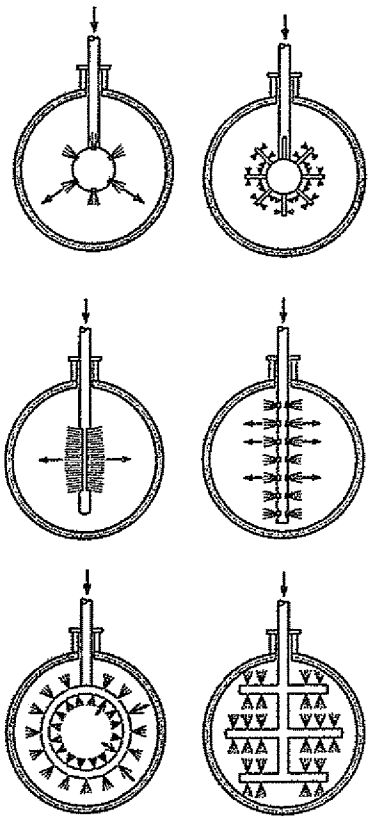
FIG. 2B illustrates various gas types of distribution apparatus suitable for use in the mixing zone of FIG. 2A.
Figure 2A:
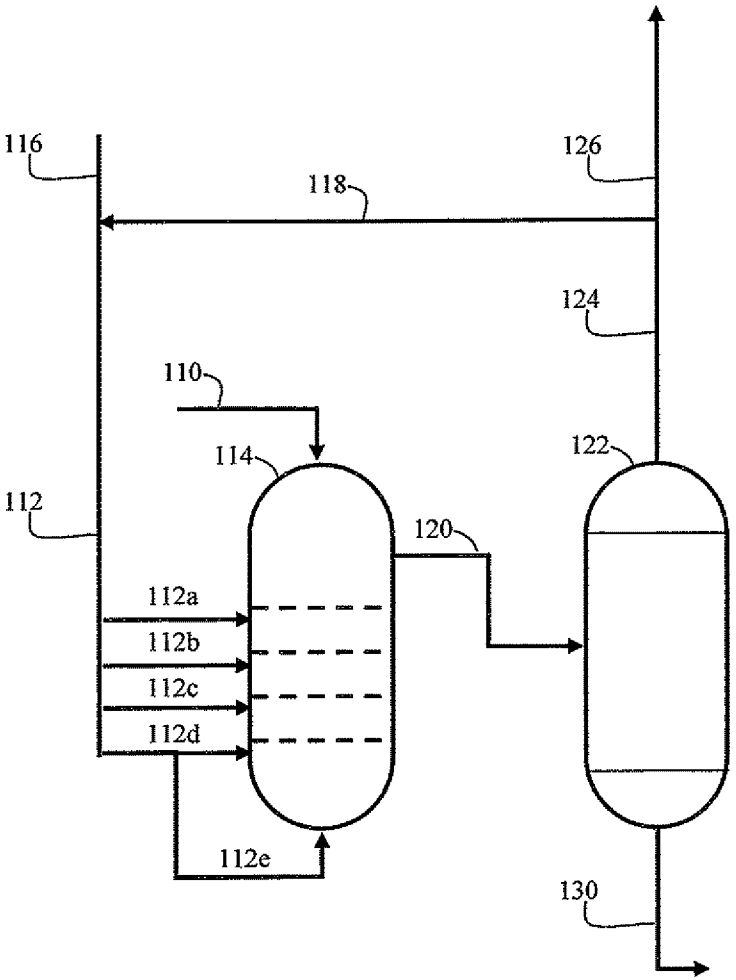
FIG. 2A is a process flow diagram of a mixing zone and flashing zone suitable for use in the process of FIG. 1.

In certain embodiments, such as, for example, shown in FIG. 2A, a column is used as a hydrogen distributor vessel 114, in which hydrogen gas 112 is injected at plural locations 112*a*, 112*b*, 112*c*, 112*d* and 112*e*. Hydrogen gas is injected thru hydrogen distributors into the column for adequate mixing to effectively dissolve hydrogen in the feedstock. For instance, suitable injection nozzles can be provided proximate several plates (locations 112*a*-112*d*) and also at the bottom of the column (location 112*e*). The liquid feedstock 110 can be fed from the bottom or top of the column.

Various types of hydrogen distributor apparatus can be used. For instance, referring to FIG. 2B, gas distributors can include tubular injectors fitted with nozzles and/or jets that are configured to uniformly distribute hydrogen gas into the flowing hydrocarbon feedstock in a column or vessel in order to achieve a saturation state in the mixing zone.

Operating conditions in the mixing zone are selected to increase the solubility of the hydrogen gas within the liquid hydrocarbon mixture. The mixing zone is maintained at pressure levels of from about 5 bars to about 200 bars in certain embodiments, and at a ratio of the normalized volume of hydrogen to the volume of liquid hydrocarbon of about 300 to about 3000 normalized liters of hydrogen per liter of liquid hydrocarbon.

The flashing zone 122 can include one or more flash drums that are maintained at suitable operating conditions to maintain a predetermined amount of hydrogen gas in solution in the liquid hydrocarbon.

Figure 3A:
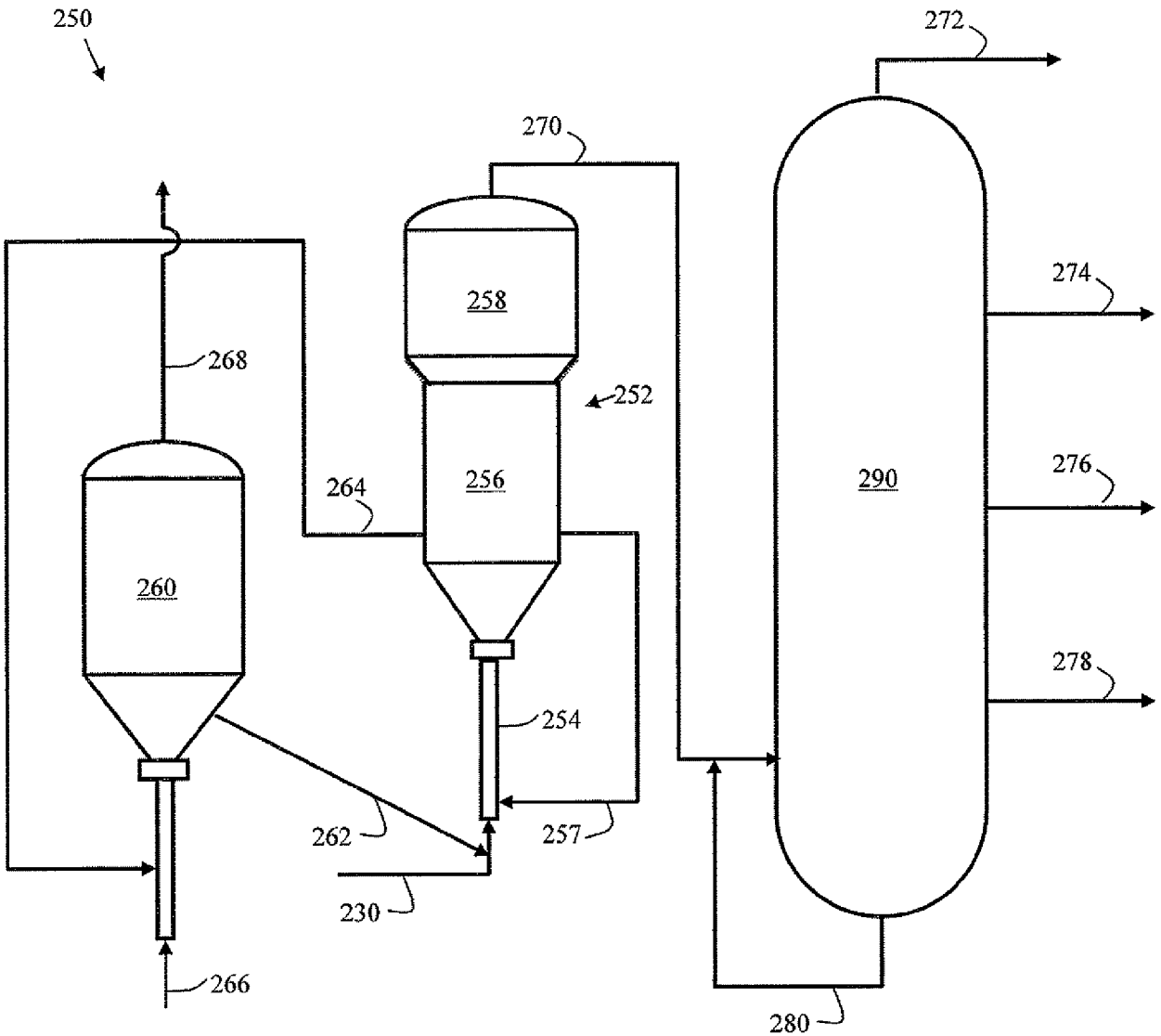
FIG. 3A is a schematic diagram of an FCC unit including a riser reactor suitable for use in the process of FIG. 1.

FIG. 3A schematically illustrates an exemplary configuration of an FCC unit 250 with a riser reactor. FCC unit 250 generally includes a reactor/separator 252 having a riser 254, a catalyst stripping portion 256 and a gas-catalyst separation portion 258. FCC unit 250 also includes a regeneration vessel 260 for regenerating spent catalyst. In addition, a distillation column 290 is illustrated for separating the reaction product gas 270 into products and by-products.

The hydrogen-enriched hydrocarbon feedstock is conveyed via conduit 230 for admixture and intimate contact with an effective quantity of heated fresh or regenerated solid cracking catalyst particles which are conveyed via a conduit 262 from regeneration vessel 260. The feed mixture and the cracking catalyst are contacted under conditions to form a suspension that is introduced into the riser 254. Other conventional operational aspects of the FCC process that are known to those of ordinary skill in the art will not be described in detail since they are not directly related to the present invention.

In a continuous process, the mixture of cracking catalyst and hydrogen-enriched hydrocarbon feedstock proceeds upward through the riser 254 into separation portion 258. The hot cracking catalyst particles catalytically crack relatively large hydrocarbon molecules by carbon-carbon bond cleavage. In addition, in the process described herein, conversion of heteroatom-containing hydrocarbons (e.g., desulfurization and denitrification) also occurs, and the reaction products from these conversion reactions (including hydrogen sulfide and ammonia) are removed from the FCC unit 250 with the cracked products.

During the reaction, as is conventional in FCC operations although to a lesser extent because of the available hydrogen for reaction, the cracking catalysts become coked and hence access to the active catalytic sites is limited or nonexistent. Reaction products are separated from the coked catalyst using any suitable configuration known for FCC units, generally referred to as the separation portion 258 in FCC unit 250, for instance, located above the catalyst stripping portion 256. The separation portion can include any suitable apparatus known to those of ordinary skill in the art such as, for example, cyclones. The reaction product gas, including desulfurized and/or denitrified products, hydrogen sulfide and/or ammonia, are withdrawn through conduit 270. Separated catalyst drops to the catalyst stripping portion 256 for stream stripping to remove excess oil before the coke deposits are combusted in the regeneration vessel 260.

The reaction product gas is fractionated in column 290 of a conventional product recovery section known to those of ordinary skill in the art. For example, product streams recovered from reaction product 270 typically include a naphtha stream 274, a light cycle oil stream 276, a heavy cycle oil stream 278 and a slurry oil stream 280. Optionally, a portion of the light oil can be recycled back to the mixing vessel 114 (in FIG. 1) to provide sufficient hydrogen to the system. In addition, an offgas stream 272 is produced which includes light hydrocarbons and in certain embodiments of the hydrogen-enriched process described herein, heteroatom gases such as hydrogen sulfide and ammonia.

Catalyst particles containing coke deposits from fluid cracking of the hydrocarbon feedstock pass from the catalyst stripping portion 256 through a conduit 264 to regeneration vessel 260. In regeneration vessel 260, the coked catalyst comes into contact with a stream of oxygen-containing gas, e.g., pure oxygen or air, which enters regeneration vessel 260 via a conduit 266. The regeneration vessel 260 is operated in a configuration and under conditions that are well known in typical FCC operations. For instance, regeneration zone 260 can operate as a fluidized bed to produce regeneration off-gas comprising combustion products which is discharged through a conduit 268. The hot regenerated catalyst is transferred from regeneration vessel 260 through conduit 262 to the bottom portion of the riser 254 for admixture with the hydrogen-enriched hydrocarbon feedstock as noted above. In certain embodiments, the regeneration vessel is a fluidized bed, and a water-free oxygen-containing gas is used to combust coke deposits from the catalyst particles, and gaseous products including carbon monoxide and carbon dioxide are discharged through conduit 268.

A slipstream of unregenerated catalyst (catalyst containing coke deposits) can be passed via conduit 257 to riser 254. Unregenerated catalyst can be recycled to the riser reactor to supply heat to the FCC unit reactants. In addition, according to the hydrogen-enriched feedstock process of the invention, certain operations result in relatively low coke accumulation per pass of catalyst, thus unregenerated catalyst also serves as a satisfactory source of active catalyst. It is noted that any quantity of catalyst contained in a slipstream as described above is to be included in any consideration or calculation of the catalyst-to-oil weight ratio of the process described herein.

In general, the operating conditions for the reactor of a suitable riser FCC unit include a feedstock temperature of about 250° C. to about 420° C.; a catalyst temperature of about 650° C. to about 700° C.; a riser temperature of about 300° C. to about 565° C.; a reactor temperature of about 400° C. to about 850° C.; a reaction pressure of about 5 bars to about 200 bars; a contact time (in the reactor) of about 1 second to about 600 seconds; and a catalyst-to-oil ratio of about 1:1 to about 30:1, and in certain embodiments of about 1:1 to about 10:1.

Figure 3B:
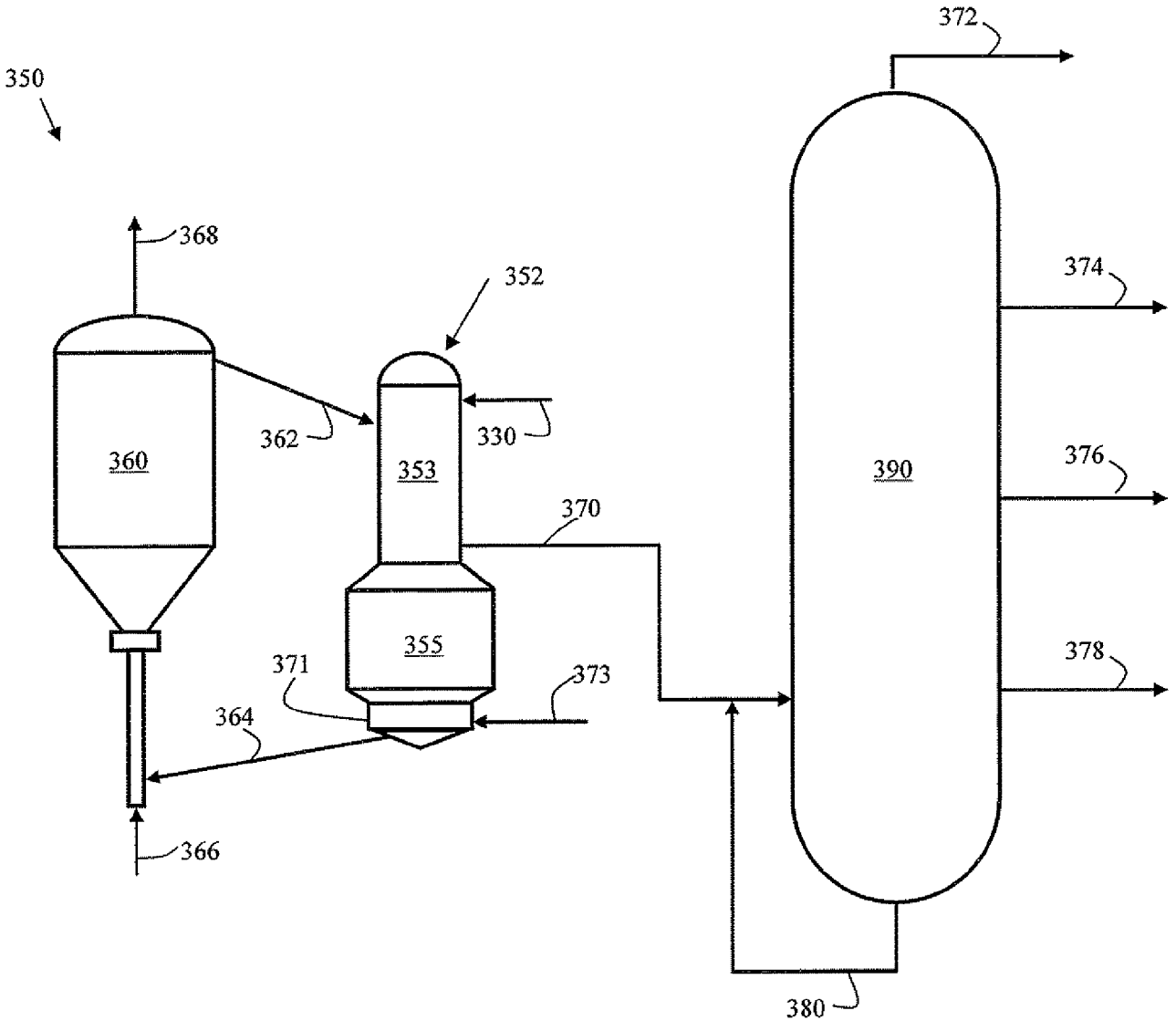
FIG. 3B is a schematic diagram of an FCC unit including a downflow reactor suitable for use in the process of FIG. 1.

Referring to FIG. 3B, there is schematically illustrated a generalized process flow diagram of an FCC unit 350 which includes a downflow reactor and can advantageously be used in the hydrogen-enriched feedstock FCC process of the present invention. FCC unit 350 includes a reactor/separator 352 having a reaction zone 353 and a separation zone 355. FCC unit 350 also includes a regeneration vessel 360 for regenerating spent catalyst. In addition, a distillation column 390 is provided for separating the reaction product 370 into products and by-products.

The hydrogen-enriched hydrocarbon feedstock is conveyed via conduit 330 to the reaction zone 353, in certain embodiments also accompanied by steam or other suitable gas for atomization of the feed. An effective quantity of heated fresh or hot regenerated solid cracking catalyst particles from regeneration zone 360 is also transferred, e.g., through a downwardly directed conduit or pipe 362, commonly referred to as a transfer line or standpipe, to a withdrawal well or hopper (not shown) at the top of reaction zone 353. Hot catalyst flow is typically allowed to stabilize in order to be uniformly directed into the reaction zone 353.

The hydrogen-enriched feedstock is injected reaction zone 353 using, for instance, multiple injection nozzles that result in the catalyst and oil mixing thoroughly and uniformly. Once the charge contacts the hot catalyst, cracking reactions occur. The reaction vapor of cracked hydrocarbon products, any unreacted feed and the catalyst mixture quickly flows through the remainder of reaction zone 353 and into a rapid separation zone 355 at the bottom portion of reactor/separator 352. Cracked and uncracked hydrocarbons are directed through a conduit or pipe 370 to a conventional product recovery section including a distillation column 390 known by those of ordinary skill in the art and described with respect to FIG. 3A.

If necessary for temperature control, a quench injection can be provided near the bottom of reaction zone 353 immediately before the separation zone 355. This quench injection quickly reduces or stops the cracking reactions and can be utilized for controlling cracking severity and allows for added process flexibility.

The reaction temperature, i.e., the outlet temperature of the downflow reactor, can be controlled by opening and closing a catalyst slide valve (not shown) that controls the flow of regenerated catalyst from regeneration zone 360 into the top of reaction zone 353. The heat required for the endothermic cracking reaction is supplied by the regenerated catalyst. By changing the flow rate of the hot regenerated catalyst, the operating severity or cracking conditions can be controlled to produce the desired yields of light olefinic hydrocarbons and gasoline.

A stripper 371 is also provided for separating oil from the catalyst, which is transferred to regeneration zone 360. The catalyst from separation zone 355 flows to the lower section of the stripper 371 that includes a catalyst stripping section into which a suitable stripping gas, such as steam, is introduced through stream 373. The stripping section is typically provided with several baffles or structured packing (not shown) over which the downwardly flowing catalyst passes counter-currently to the flowing stripping gas. The upwardly flowing stripping gas, which is typically steam, is used to "strip" or remove any additional hydrocarbons that remain in the catalyst pores or between catalyst particles.

The stripped or spent catalyst is transported by lift forces from the combustion air stream 366 through a lift riser of the regeneration zone 360. This spent catalyst, which can also be contacted with additional combustion air, undergoes controlled combustion of any accumulated coke. Fuel gases are removed from the regenerator via conduit 368. In the regenerator, the heat produced from the combustion of the by-product coke is transferred to the catalyst raising the temperature required to provide heat for the endothermic cracking reaction in the reaction zone 353.

Catalysts that are suitable for the particular charge and the desired product or product range is conveyed to the fluidized catalytic cracking reactor within the FCC reaction and separation zone. The active catalyst metal can be selected from the one or more of cobalt, tungsten, nickel, vanadium, molybdenum, platinum, palladium, copper, iron, or a mixture thereof, in elemental or compound form. The active metal is typically supported on a base zeolitic matrix, although other suitable base structures can be used, such as one or more clays such as kaolin, montmorilonite, halloysite and bentonite, and/or one or more inorganic porous oxides such as alumina, silica, boria, chromia, magnesia, zirconia, titania and silica-alumina.

In addition, particularly in embodiments in which conversion of certain heteroatom-containing hydrocarbons to heteroatom-free hydrocarbons is required, a predetermined quantity of a suitable hydrotreating catalyst can be incorporated. For instance, a hydrocracking catalyst can include any one of, or combination including amorphous alumina catalysts, amorphous silica alumina catalysts and, zeolite-based catalysts. The hydrocracking catalyst can possess an active phase material including, in certain embodiments, any one of, or combination including Ni, W, Co and Mo. The hydrotreating catalyst can be provided on separate support matrixes and admixed with the FCC catalyst(s). In additional embodiments, active hydrocracking catalyst metals can be incorporated on the support matrixes with the FCC catalyst thereby using dual-function catalyst particles.

In typical FCC processes, a large amount of fresh or regenerated catalyst is used with a very short reactant residence time (e.g., 0.1 to 30 seconds) to crack heavy hydrocarbons at relatively high reaction temperatures and low pressures. The hydrocarbon cracked hydrocarbon compounds are discharged from the reactor in this short residence time. During FCC processes, two types of cracking reactions occur, thermal cracking and catalytic cracking. Thermal cracking refers to the conversion of high molecular weight compounds at high temperatures into low molecular weight ones. These reactions follow the free radical mechanisms, with homolytic fission of the C—C bond as an initiation step followed by hydrogen extraction of a methyl radical from a secondary carbon atom to form a more stable radical. In catalytic cracking, high molecular weight compounds are converted to carbenium ions by protonation. The carbenium ions are cracked into lower molecular weight paraffins and olefins through β-scission reactions followed by intramolecular rearrangements and deprotonation. Paraffins can undergo molecular rearrangement for conversion into olefins. While not wishing to be bound by any particular theory, it is believed that in the process described herein, dissolved hydrogen atomizes with the feedstock and is readily available for cleavage and recombination reactions, thereby modifying the conventional reaction mechanisms in FCC processes. In the presence of hydrogen, the cleavage of the C—C bond in an n-paraffin molecule produces two primary radicals. These primary radicals react selectively with hydrogen to produce lower molecular weight hydrocarbons and hydrogen radicals in a short residence time. The hydrogen radicals propagate the chain by extracting hydrogen from other hydrocarbon molecules and producing secondary radicals. Further reactions, i.e., splitting, of the secondary radicals can occur to produce a 1-olefin and a primary radical, which is then saturated by hydrogen to yield a hydrocarbon with regeneration of the reaction chain:

$$R—(CH_2)_6—R' \rightarrow R—CH_2—CH_2—CH_2.+.CH_2—CH_2—CH_2—R'$$

$$R—CH_2—CH_2—CH_2.+H_2 \rightarrow R—CH_2—CH_2—CH_3+H.$$

$$H.+R—(CH_2)_6—R' \rightarrow R—(CH_2)—CH.—(CH_2)_4—R'+H_2$$

$$R—(CH_2)—CH.(CH_2)_4—R' \rightarrow R—CH_2—CH.+CH_2=CH—CH_2—CH_2—R'$$

$$R—CH_2—CH.+H_2 \rightarrow R—CH_2—CH_3+H.$$

In addition to cracking reactions, conversion of certain heteroatom-containing hydrocarbons to heteroatom-free hydrocarbons is also facilitated in the presence of hydrogen. For example, sulfur heteroatoms are removed from sulfur-containing hydrocarbon compounds to produce hydrogen sulfide, and nitrogen heteroatoms are removed from nitrogen-containing hydrocarbon compounds to produce ammonia.

In order for the benefits of added hydrogen to be attained, there must be sufficient residence time and the hydrogen must be available for reaction. Since the residence time in FCC processes is typically very short, this is a significant challenge according to conventional approaches of FCC processes involving a significant gas phase and stoichiometric excess of hydrogen. In particular, the significant gaseous phase of hydrogen results in stripping of light reaction products. This stripping effect is minimized or eliminated using the hydrogen-enriched feedstock according to the process of the present invention.

The hydrogen dissolved in the liquid feedstock according to the present process will atomize with the feedstock and be readily available for cracking and heteroatom removal reactions. Similarly, the available hydrogen reacts with carbonium ions formed in the presence of cracking catalyst, and stabilizes the carbenium ions to form low molecular weight hydrocarbons. Further, coke formation is minimized because heavy molecules are stabilized rather than forming condensates.

Figure 4:
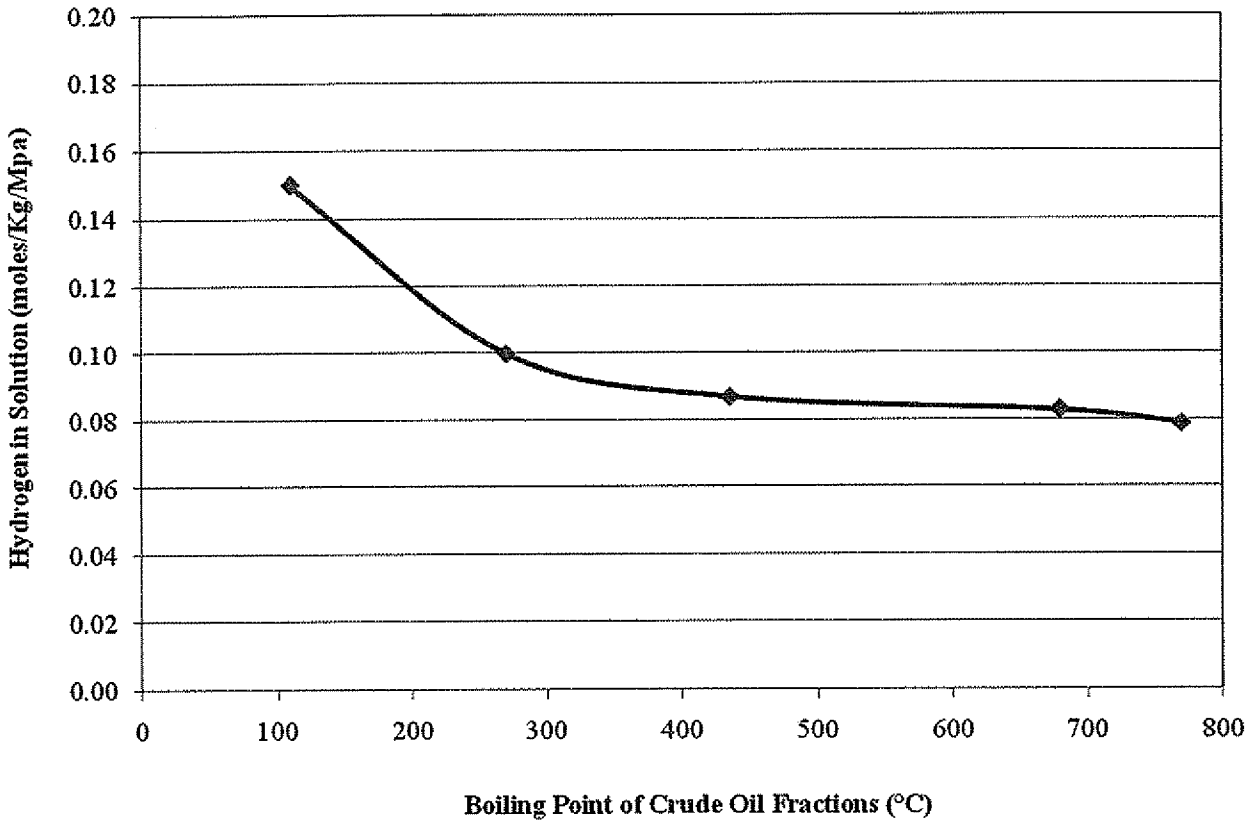
FIG. 4 is a graphic plot of hydrogen solubility in hydrocarbons versus the boiling point of crude oil fractions.

Using the mixing zone and flashing zone described herein, a functionally effective amount of hydrogen can be dissolved in the liquid hydrocarbon feedstock. The amount of hydrogen dissolved in the feedstock depends on various factors, including the operating conditions of the mixing zone and the flashing zone, and the boiling point of the feed. As shown by the solubility data in the graphic plot of FIG. 4, hydrogen is more soluble in the lower boiling point, relatively lighter hydrocarbon fractions than in the heavier fractions.

The method and system of the present invention have been described above and in the attached drawings; however, modifications will be apparent to those of ordinary skill in the art based on this description and the scope of protection for the invention is to be defined by the claims that follow.

What is claimed is:

1. A process for conversion of a liquid hydrocarbon feedstock into lower molecular weight hydrocarbon compounds in a fluidized catalytic cracking reaction and separation zone, the process comprising:

a. mixing the liquid hydrocarbon feedstock and an excess of hydrogen gas in a mixing zone to dissolve a portion of the hydrogen gas in the liquid hydrocarbon feedstock to produce a hydrogen-enriched liquid hydrocarbon feedstock;

b. introducing the hydrogen-enriched liquid hydrocarbon feedstock and remaining undissolved hydrogen into a flashing zone in which at least a portion of the undissolved hydrogen gas is flashed;

c. passing the hydrogen-enriched liquid hydrocarbon feedstock from the flashing zone to the fluidized catalytic cracking reaction and separation zone containing fluidized solid catalytic cracking catalyst for reaction including conversion of the liquid hydrocarbon feedstock into lower boiling point hydrocarbons; and d. recovering converted hydrocarbon products from the fluidized catalytic cracking reaction and separation zone.

2. The process of claim 1, wherein the liquid hydrocarbon feedstock includes sulfur-containing hydrocarbon compounds and the process includes reacting the hydrogen and sulfur-containing hydrocarbon compounds to produce desulfurized hydrocarbon compounds and hydrogen sulfide, and recovering hydrogen sulfide along with converted hydrocarbon products from the fluidized catalytic cracking reaction and separation zone.

3. The process of claim 1, wherein the liquid hydrocarbon feedstock includes nitrogen-containing hydrocarbon compounds and the process comprises reacting the hydrogen and nitrogen-containing hydrocarbon compounds to produce denitrified hydrocarbon compounds and ammonia, and recovering ammonia along with converted hydrocarbon products from the fluidized catalytic cracking reaction and separation zone.

4. The process of claim 1, wherein hydrogen is recovered from the flashing zone and recycled for mixing with the liquid hydrocarbon feedstock in the mixing zone.

5. The process of claim 1, wherein the mixing zone comprises a hydrogen distributor vessel in which the hydrogen gas is contacted with the hydrocarbon feedstock under turbulent flow conditions.

6. The process of claim 5, wherein the distributor vessel includes a plurality of injection ports.

7. The process of claim 1, wherein the mixing zone is maintained at a pressure in the range of from about 5 bars to about 200 bars.

8. The process of claim 1, wherein the volumetric ratio of the normalized volume of hydrogen to the volume of liquid hydrocarbon in the mixing zone is maintained in the range of from about 300:1 to about 3000:1.

9. The process of claim 1, wherein the liquid hydrocarbon feedstock is selected from the group consisting of crude oil, synthetic crude oil, cracked bitumen, oil sand, cracked shale oil, coal liquids, vacuum gas oil, deasphalted oil, demetallized oil, unconverted hydrocracker bottoms, hydrocracker recycle streams, hydrotreated vacuum gas oil, light coker gas oil, heavy coker gas oil, light cycle oil, heavy cycle oil, clarified slurry oil, visbreaking gas oil, and combinations thereof.

10. The process of claim 1, wherein the converted hydrocarbon products include a naphtha stream, a light cycle oil stream, a heavy cycle oil stream and a slurry oil stream.

11. The process of claim 10, wherein the light cycle oil is recycled to the mixing zone in step (a) of claim 1.

12. The process of claim 1 which further comprises introducing a hydrocracking catalyst into the fluidized catalytic cracking reaction and separation zone to promote conversion of heteroatom-containing hydrocarbons to heteroatom-free hydrocarbons.

13. The process of claim 1, wherein the pressure and temperature of the feedstock effluent from the flash zone are maintained to maximize the concentration of dissolved hydrogen entering the fluidized catalytic cracking and separation zone.

* * * * *